United States Patent [19]

Mochida et al.

[11] Patent Number: 4,972,695

[45] Date of Patent: Nov. 27, 1990

[54] ANTI-PICK CYLINDER LOCK

[75] Inventors: Haruo Mochida, Kanagawa; Toshikazu Kobayashi, Tokyo; Hidekazu Sato, Tokyo; Mikio Masaki, Tokyo, all of Japan

[73] Assignees: Nissan Motor Co., Ltd., Yokohama; Kokusan Kinzoku Kogyo Kabushiki Kaisha, Tokyo, both of Japan

[21] Appl. No.: 298,693

[22] Filed: Jan. 19, 1989

[30] Foreign Application Priority Data

Jan. 22, 1988 [JP] Japan ..... 63-5991[U]

[51] Int. Cl.[5] ..... E05B 29/04

[52] U.S. Cl. ..... 70/492; 70/377

[58] Field of Search ..... 70/492, 421, 376, 377, 70/392, 495

[56] References Cited

U.S. PATENT DOCUMENTS

| | | | |
|---|---|---|---|
| 450,341 | 4/1891 | Russell, Jr. | 70/492 |
| 466,918 | 1/1892 | Forster et al. | 70/492 X |
| 1,556,606 | 10/1925 | Jacobi et al. | 70/492 |
| 1,860,708 | 5/1932 | Falk | 70/492 |
| 2,023,207 | 12/1935 | Olson | 70/492 X |
| 2,079,628 | 5/1937 | Olson | 70/492 |
| 2,330,929 | 10/1943 | Shinn | 70/492 X |
| 3,705,507 | 12/1972 | Sanders et al. | 70/492 X |
| 4,292,823 | 10/1981 | Reinhard et al. | 70/492 |

FOREIGN PATENT DOCUMENTS

| | | | |
|---|---|---|---|
| 593539 | 3/1934 | Fed. Rep. of Germany | 70/492 |

*Primary Examiner*—Lloyd A. Gall

*Attorney, Agent, or Firm*—Foley & Lardner, Schwartz, Jeffery, Schwaab, Mack, Blumenthal & Evans

[57] ABSTRACT

Disclosed herein is a cylinder lock which is proof against lock pickers. The cylinder lock comprises a case having a cylindrical bore formed therein and an axially extending lock groove exposed to the cylindrical bore; a rotor rotatably disposed in the cylindrical bore; a plurality of tumblers slidably received in slits formed in the rotor, each tumbler having a head which is projectable into the lock groove when the rotor assumes a given angular position relative to the case; springs for biasing the tumblers radially outward from the slits of the rotor; and a structure for making the distances by which the heads of the tumblers are projected into the lock groove of the case different from one another.

6 Claims, 2 Drawing Sheets

ANTI-PICK CYLINDER LOCK

BACKGROUND OF THE INVENTION

1. Field of the Invention

The present invention relates in general to a lock, and more particularly, to a cylinder lock including tumblers. More specifically, the present invention is concerned with a cylinder lock which has proof against lock picker.

2. Description of the Prior Art

In order to clarify the object of the present invention, one conventional cylinder lock will be described with reference to FIGS. 4 and 5 of the accompanying drawings, which is shown in Japanese Patent first Provisional Publication No. 60-30542.

As shown in the drawings, the cylinder lock "S" disclosed by the publication comprises generally a cylindrical case 1, a rotor 2 rotatably installed in the case 1 and a series of tumblers 3-1, 3-2, 3-3 and 3-4 carried by the rotor 2. The case 1 is formed at its inner cylindrical wall with an axially extending lock groove 1*a*. The tumblers are slidably received in respective slits 2*a* formed through the rotor 2. The slits 2*a* extend across the axis of the rotor 2. As is seen from FIG. 5, each tumbler 3-3, 3-1, 3-2 or 3-4 is biased in one direction by a spring 4 which is compressed between a projection 3*a* of the tumbler and a stepped portion 2*b* of the rotor 2. That is, when the rotor 2 assumes a locked position relative to the case 1, a head 3*b* of each tumbler 3-3, 3-1, 3-2 or 3-4 is projected into the lock groove 1*a* of the case 1, due to the force of the spring 4, thereby blocking the rotation of the rotor 2 relative to the case 1. The tumblers 3-3, 3-1, 3-2 and 3-4 are formed with respective apertures 3-c1, 3-c2, 3-c3 and 3-c4 which are exposed to a bore 2*c* of the rotor 2. The apertures 3-c1, 3-c2, 3-c3 and 3-c4 are positioned to incorporate with serrations of a key (not shown). Upon insertion of the key into the rotor 2, the serrations of the key are brought into engagement with the corresponding apertures 3-c1, 3-c2, 3-c3 and 3-c4 of the tumblers 3-3, 3-1, 3-2 and 3-4 thereby drawing the heads 3*b* of the tumblers 3-3, 3-1, 3-2 and 3-4 into the rotor 2 against the force of the compression springs 4. Under this condition, the rotor 2 is permitted to rotate relative to the case 1. FIG. 4 shows a shear line $\lambda_1$ for the heads 3*b* of the tumblers, which is defined by the cylindrical outer surface of the rotor 2 at the portions to which the slits 2*a* for the tumblers are exposed. That is, when the heads 3*b* of the tumblers 3-3, 3-1, 3-2 and 3-4 are drawn from the line $\lambda_1$, the rotor 2 is permitted to turn by the key.

As is shown in FIG. 4, under a locked condition, the heads 3*b* of the tumblers 3-1, 3-2, 3-3 and 3-4 are equally projected into the lock groove 1*a* of the case 1 by the same degree. That is, under such condition, the portions of the tumbler heads 3*b* projected outward from the shear line $\lambda_1$ are equal in length.

However, the equally projecting manner of the tumbler heads 3*b* induces the following drawback.

That is, as is pointed by the afore-mentioned publication, if the gap G-1, G-2, G-3 or G-4 of the aperture 3*c* of each tumbler 3-1, 3-2, 3-3 or 3-4 relative to a reference line $\lambda_2$ (namely, the axis of the rotor 2) is detected by any measuring means (for example, picking pin or the like), a copy of the key is easily but wrongfully available. This is because the distances by which the four tumblers are moved for getting under the shear line $\lambda_1$ are equal. The copy of the key is thus easily produced by providing the serrations thereof with shapes and sizes which correspond, but reversely, to those of the respective gaps G-1, G-2, G-3 and G-4 of the tumblers 3-1, 3-2, 3-3 and 3-4.

SUMMARY OF THE INVENTION

It is therefore an object of the present invention to provide a cylinder lock which is free of the above-mentioned drawback.

According to the present invention, there is provided a cylinder lock in which, under locked condition, the heads of the tumblers projected outward from the rotor have different lengths.

According to the present invention, there is provided a cylinder lock which comprises a case having a cylindrical bore formed therein and an axially extending lock groove exposed to the cylindrical bore; a rotor rotatably disposed in the cylindrical bore; a plurality of tumblers carried by the rotor, each tumbler having a head which is projectable into the lock groove when the rotor assumes a given angular position relative to the case; springs for biasing the tumblers radially outward from the rotor; and means for making the distances by which the heads of the tumblers are projected into the lock groove of the case different from one another.

BRIEF DESCRIPTION OF THE DRAWINGS

Other objects of the present invention will become apparent from the following description when taken in conjunction with the accompanying drawings, in which.

DETAILED DESCRIPTION OF THE INVENTION

Figure 1:
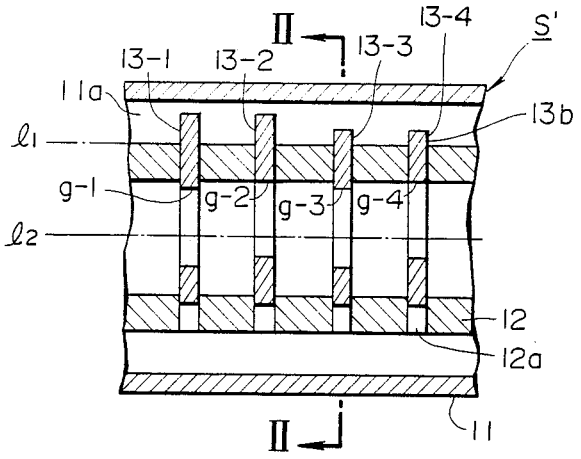
FIG. 1 is a partial sectional view of a cylinder lock of a first embodiment of the present invention.
Figure 2:
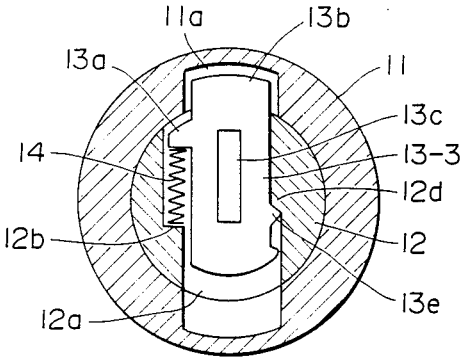
FIG. 2 is a sectional view taken along the line II—II of FIG. 1.

Referring to FIGS. 1 and 2, there is shown a cylinder lock "S'" which is a first embodiment of the present invention.

It is to be noted that these drawings show a locked condition of the cylinder lock "S'".

Similar to the afore-mentioned conventional cylinder lock "S", tumblers 13-1, 13-2, 13-3 and 13-4 are slidably received in respective slits 12*a* of a rotor 12 and are each biased in one direction by a spring 14 which is compressed between a projection 13*a* of the tumbler and a stepped portion 12*b* of the rotor 12.

However, in the invention, two (viz., the tumblers 13-3 and 13-4) of the four tumblers have projection degree restricting means which controls or reduces the degree by which the heads 13*b* thereof are projected into a lock groove 11*a* of a case 11. That is, as is seen from FIG. 2, for this control, each tumbler 13-3 or 13-4 has a projection 13*e* which is engageable with a stepped portion 12*d* formed on the wall of the slit 12*a* of the rotor 12. By changing the position of the projection 13*e* or the stepped portion 12*d*, the degree by which the head 13*b* of the tumbler 13-3 or 13-4 is projected from the shear line $\lambda_1$ can be adjusted.

Thus, as is seen from FIG. 1, when the lock "S'" is in the locked condition, the heads 13*b* of the tumblers 13-1 and 13-2 are largely projected into the lock groove 11*a* of the case 11, while, the heads 13*b* of the other two tumblers 13-3 and 13-4 are slightly projected into the lock groove 11*a*.

Because of this difference in projection degree of the tumblers 13-1, 13-2, 13-3 and 13-4, the following advantage is given eliminating the drawback encountered in the above-mentioned conventional cylinder lock "S".

That is, the distance by which the tumblers 13-3 and 13-4 are drawn for getting under the shear line $\lambda_1$ is different from that of the other two tumblers 13-1 and 13-2. In other words, the gaps g-3 and g-4 of the apertures 13*c* of the tumblers 13-3 and 13-4 do not correspond to the actually moved distance of the tumblers 13-3 and 13-4 needed for drawing the heads 13*b* of the same under the shear line $\lambda_1$. Thus, even when the serrations of a copy key are provided with shapes and sizes corresponding to those of the respective gaps g-1, g-2, g-3 and g-4 of the apertures 13*c* of the four tumblers 13-1, 13-2, 13-3 and 13-4, the copy key can not cancel the locked condition of the cylinder lock "S'".

Figure 3:
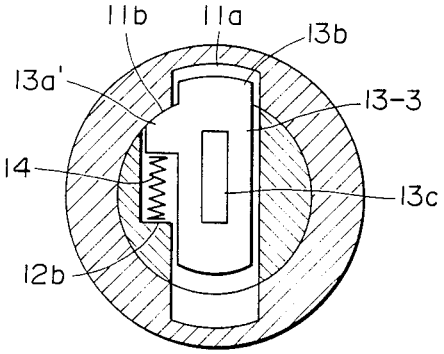
FIG. 3 is a view similar to FIG. 1, but showing a second embodiment of the present invention.
Figure 4:
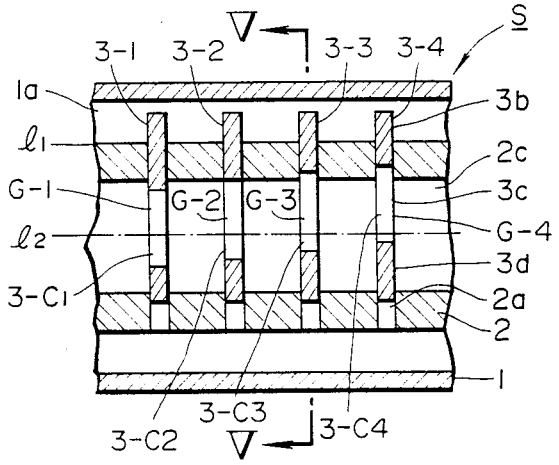
FIG. 4 PRIOR ART
FIG. 4 is a partial sectional view of a conventional cylinder lock.
Figure 5:
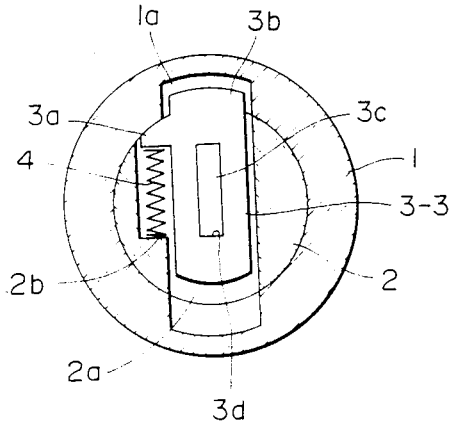
FIG. 5 PRIOR ART
FIG. 5 is a sectional view taken along the line V—V of FIG. 4.

Referring to FIG. 3, there is shown a second embodiment of the invention. In this embodiment, the projection 13*a'* on which one end of the spring 14 is seated serves also as the projection degree restricting means. That is, upon projection of the head 13*b* of the tumbler 13-3 into the lock groove 11*a*, the shoulder part of the projection 13*a'* is brought into abutment with the cylindrical wall 11*b* of the case 11 thereby to control the projection of the heads 13*b* into the lock groove 11*a*.

What is claimed is:

1. A cylinder lock comprising:

a case having a cylindrical bore formed therein and an axially extending lock groove exposed to said cylindrical bore;

a rotor rotatably disposed in said cylindrical bore, said rotor having an axis about which said rotor rotates;

a plurality of tumblers slidably received in slits formed in said rotor, each tumbler having a head which is projectable into said lock groove and having formed therethrough a generally rectangular aperture which has a given end near said head, the heads of said tumblers being projected into said lock groove when said tumblers assume given terminal positions upon turning said rotor to a lock position relative to said case;

spring means for biasing said tumblers radially outward from the slits of said rotor;

first means for making the respective distances by which the heads of the tumblers are projected into said lock groove of said case different from one another; and wherein said plurality of tumblers comprises first and second groups of tumblers, each tumbler of said first group being so arranged that, upon said tumblers assuming said given terminal positions, the distance between said axis of said rotor and said given end of said aperture is equal to a first predetermined value and each tumbler of said second group being so arranged that, upon said tumblers assuming said given positions, the distance between said axis of said rotor and said given end of said aperture is equal to a second predetermined value, wherein each of said first and second groups comprises tumblers comprising said heads which projects with different distances into said lock groove.

2. A cylinder lock as claimed in claim 1, in which said first means comprises:

a projection formed on a selected one of said tumblers; and a stopper portion formed on either one of said rotor and said case;

wherein said projection is brought into abutment with said stopper portion when the head of the selected tumbler is moved into said lock groove by a given distance.

3. A cylinder lock as claimed in claim 2, in which said stopper portion is a stepped portion formed on a wall of the slit of said rotor in which the selected tumbler is received.

4. A cylinder lock as claimed in claim 2, in which said stopper portion is a portion of the wall of the cylindrical bore of said case.

5. A cylinder lock as claimed in claim 4, in which said projection comprises a part on which one end of the associated spring means is seated.

6. A cylinder lock as claimed in claim 2, in which two of said tumblers are arranged to have their heads projected into said lock groove by the same distance.

* * * * *